US005555083A

United States Patent [19]

Kuo et al.

[11] Patent Number: 5,555,083

[45] Date of Patent: Sep. 10, 1996

[54] DECURLER APPARATUS FOR REDUCING CROSS CURL IN SHEETS

[75] Inventors: Youti Kuo, Penfield; James F. Smoak, Webster, both of N.Y.

[73] Assignee: Xerox Corporation, Stamford, Conn.

[21] Appl. No.: 317,254

[22] Filed: Oct. 3, 1994

[51] Int. Cl.[6] ..... G03G 21/00

[52] U.S. Cl. ..... 355/309; 162/197; 162/271; 271/188; 271/209

[58] Field of Search ..... 355/309, 290, 355/282, 285, 290; 162/197, 270–1; 271/188, 209, 161

[56] References Cited

U.S. PATENT DOCUMENTS

| | | | |
|---|---|---|---|
| 4,077,519 | 3/1978 | Huber | 209/74 R |
| 4,326,915 | 4/1982 | Mutschler, Jr. | 162/271 |
| 4,360,356 | 11/1982 | Hall | 493/459 |
| 4,475,896 | 10/1984 | Bains | 493/454 |
| 4,922,234 | 5/1990 | Murphy | 340/608 |
| 4,977,432 | 12/1990 | Coombs et al. | 355/309 |
| 5,012,290 | 4/1991 | Berkes | 355/271 |
| 5,061,967 | 10/1991 | Isobe | 355/310 |
| 5,066,984 | 11/1991 | Coombs | 355/309 |
| 5,267,008 | 11/1993 | Rebres et al. | 355/308 |
| 5,292,115 | 3/1994 | Egi et al. | 271/122 |
| 5,357,327 | 10/1994 | Solano et al. | 355/282 |
| 5,414,503 | 5/1995 | Siegel et al. | 355/309 |

*Primary Examiner*—Sandra L. Brase
*Assistant Examiner*—T. A. Dang
*Attorney, Agent, or Firm*—William A. Henry, II

[57] ABSTRACT

A decurler for reducing cross curl in sheets includes at least one grooved elastomer transport belt and a ribbed pinch shaft. The ribs of the decurler shaft extend into the grooves in the belt to provide one-sided corrugations to a passing sheet and provide distributed localized bending of the copy sheet in the area of the belt grooves. Distributed local bending in the cross direction, as well as, in the wrap in the process direction around the ribbed decurler shaft provide cross curl reduction in the process direction.

12 Claims, 3 Drawing Sheets

DECURLER APPARATUS FOR REDUCING CROSS CURL IN SHEETS

BACKGROUND OF THE INVENTION

This invention relates generally to a printing unit or processor, such as, an office copier, facsimile or non-impact printer, and more particularly concerns an apparatus for decurling sheet material employed therein.

Generally, electrophotographic printing comprises charging a photoconductive member to a substantially uniform potential so as to sensitize the surface thereof. The charged portion of the photoconductive surface is exposed to a light image of the original document being reproduced. This records an electrostatic latent image on the photoconductive member which corresponds to the informational areas contained within the original document being reproduced. This records an electrostatic latent image on the photoconductive member which corresponds to the informational areas contained within the original document. The latent image is developed by bringing a developer material into contact therewith. In this way, a powder image is formed on the photoconductive member which is subsequently transferred to a sheet of support material. The sheet of support material is then heated to permanently affix the powder image thereto.

As the sheet of support material passes through the various processing stations in the electrophotographic printing machine, a curl or bend is frequently induced therein. Occasionally, this curl or bend may be inherent in the sheet of support material due to the method of manufacture thereof. It has been found that this curl is variable from sheet to sheet within the stack of sheets utilized in the printing machine. The curling of the sheet of support material causes problems of handling as the sheet is processed in the printing machine. Sheets delivered in a curled condition have a tendency to have their edges out of registration with the aligning mechanisms employed in the printing machine. In addition, curled sheets tend to produce jams or misfeeds within the printing machine. In the past, this problem has been resolved by utilizing bars, rollers or cylinders which engage the sheet material as it passes through the printing machine. Frequently, belts or soft rollers are used in conjunction with a hard penetrating roll to remove the curl in a sheet. Decurler systems of this type reduce paper curl in the process direction only. But, once the curl in that direction is reduced, the curl in the cross-direction (perpendicular to the process direction) will appear. This phenomenon is due to the isotropic nature of paper curl that the paper fiber structure on one side tends to contract more than the other side in all directions. Originally, if the curl in the process direction is severe, curl-induced stiffness tends to inhibit the curling in the cross-direction. When the process direction curl is removed and the stiffness is reduced, cross curl becomes free to develop.

Various approaches have been devised to improve sheet decurlers to answer some of the above-detailed problems. The following disclosures appear relevant:

U.S. Pat. No. 4,077,519; Patentee: Huber; issued Mar. 7, 1978.

U.S. Pat. No. 4,326,915; Patentee: Mutschler, Jr.; issued Apr. 27, 1982.

U.S. Pat. No. 4,360,356; Patentee: Hall; issued Nov. 23, 1982.

U.S. Pat. No. 4,475,896; Patentee: Bains; issued Oct. 9, 1984.

U.S. Pat. No. 4,977,432; Patentee: Coombs et al.; issued Dec. 11, 1990.

U.S. Pat. No. 5,066,984; Patentee: Coombs; issued Nov. 19, 1991.

The pertinent portions of the foregoing disclosures may be summarized as follows:

Huber describes a curl detector and separator wherein a paper sheet is passed through the nip of a rotating roll and charging roll, and thereafter the sheet is stripped from the rotating roll by a vacuum stripper which allows the sheet to pass between the nip of a subsequent transport roll pair.

Mutschler, Jr. discloses a sheet decurler apparatus wherein a sheet is pressed into contact with a rigid arcuate member in at least two regions. The sheet moves about the arcuate member or rod in a curved path to remove curl in the sheet. The sheet is bent in one direction by a first rod and in another direction by a second rod.

Hall discloses an apparatus for removing curl from continuous web material during its travel through engagement bars that can be adjusted to remove away from image (AI) or toward image (TI) curl.

Bains describes a curling/decurling mechanism that combines a compliant roller with a soft outer layer in a curling roller to form a penetration nip with the compliant roller. Movable parts are employed to control the angle of sheets as they exit from the nip.

Coombs et al. is directed to a decurling device that includes an arcuate concave guide and a feed roll which causes paper to pass between the guide and the feed roll to decurl the paper. A means is included for selectively laterally offsetting paper driven through the device.

Coombs describes a decurling device that includes an arcuate concave guide and a feed roll which causes paper to pass between the guide and the feed roll to decurl the paper. The space between the guide and the roll is greater than the thickness of the paper and the paper is bent in the direction opposite to its curl as it passes through the arched space.

The present invention aims at providing a decurler designed with the capability of reducing cross curl by distributed local bending of sheets.

SUMMARY OF THE INVENTION

Accordingly, the present invention provides a decurler that includes a belt transport with grooved elastomer transport belt(s) and a ribbed decurler shaft that provides local bending of a copy sheet in the area of the belt grooves. Distributed local bending in the cross direction, as well as, in the wrap in the process direction around the ribbed decurler shaft simultaneously provide cross curl reduction and the reduction of curl in the process direction.

BRIEF DESCRIPTION OF THE DRAWINGS

The foregoing and other features of the instant invention will be apparent from a further reading of the specification, claims and from the drawings in which:

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

The invention will now be described by reference to a preferred embodiment of the decurler system of the present invention preferably for use in a conventional copier/printer. However, it should be understood that the sheet decurling method and apparatus of the present invention could be used with any machine environment in which decurling of sheets is desired.

In general, an improvement over prior sheet decurling systems in machines is disclosed which is cost effective and comprises the use of a shaft with ribs spaced along the axis of the shaft that are engaged with grooved elastomeric belts or rolls to provide local bendings to reduce cross curl of a copy sheet whose process direction curl has been previously reduced or eliminated by another decurler. Process direction curl is defined as curl in the direction of movement of a sheet and cross direction curl is the curl that is transverse to the process direction.

Figure 3:
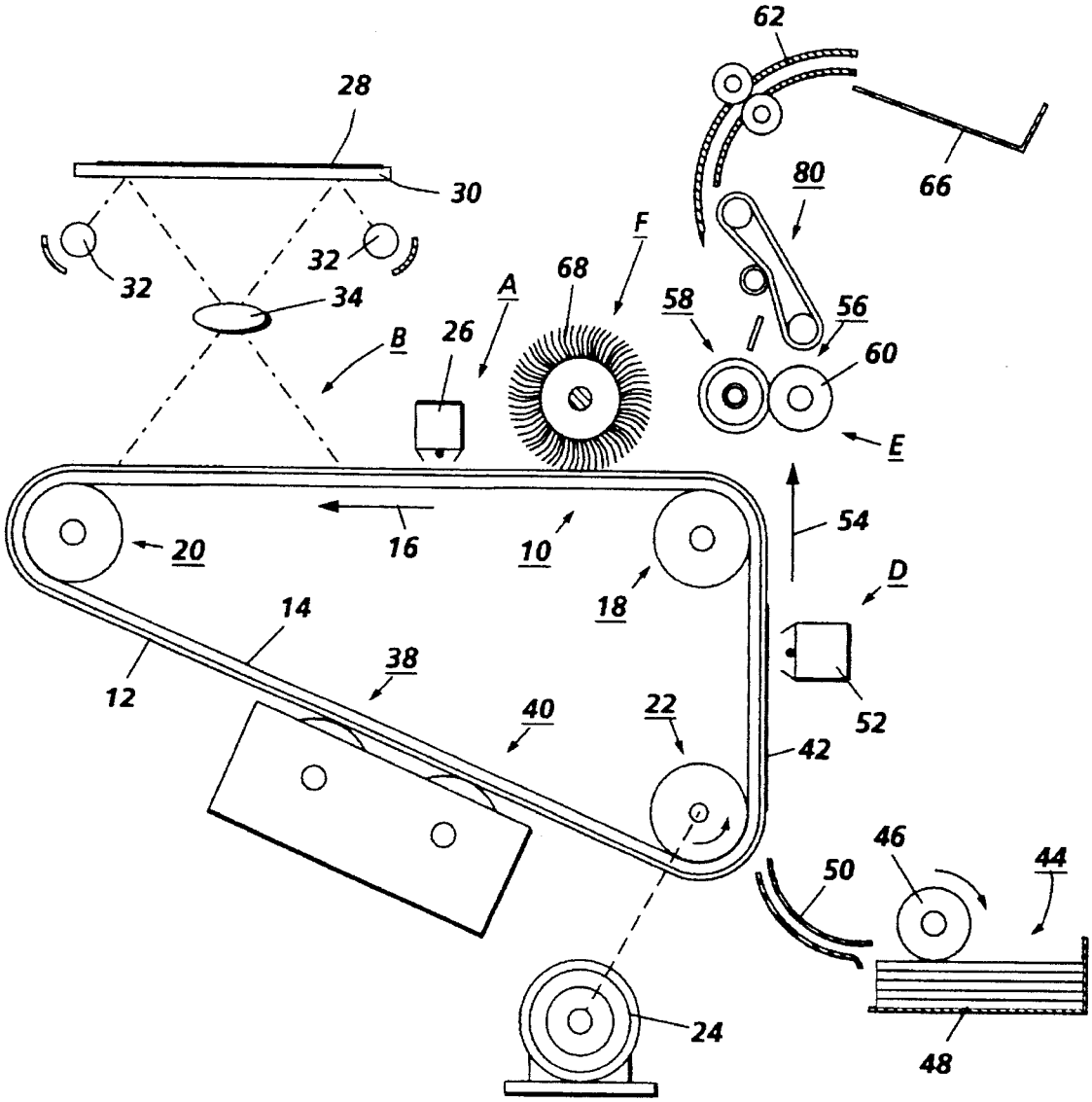
FIG. 3 is an elevational view illustrating schematically an electrophotographic printing machine incorporating the decurler of FIG. 1 therein.

For a general understanding of the features of the present invention, reference is made to the drawings. In the drawings like reference numerals have been used throughout to designate identical elements. FIG. 3 schematically depicts the various components of an illustrative electrophotographic printing machine incorporating the decurling apparatus of the present invention therein. It will become evident from the following discussion that the decurling apparatus is equally well suited for use in a wide variety of printing machines and is not necessarily limited in its application to the particular embodiment shown herein. In addition, the location of the decurling apparatus, as depicted in the FIG. 3 electrophotographic printing machine, may be varied. The decurling apparatus may be positioned intermediate any of the processing stations within the printing machine. In the printing machine depicted in FIG. 3, multiple decurlers are positioned after the fusing station prior to the catch tray so as to straighten the final copy sheet prior to removal from the printing machine by the operator. However, this location is merely illustrative of the operation of the decurling apparatus and may be varied.

Inasmuch as the art of electrophotographic printing is well known, the various processing stations employed in the FIG. 3 printing machine will be shown hereinafter schematically and their operation described briefly with reference thereto.

As shown in FIG. 3, the electrophotographic printing machine employs a belt 10 having a photoconductive surface 12 deposited on a conductive substrate 14. Preferably, photoconductive surface 12 comprises a transport layer having small molecules of m-TBD dispersed in a polycarbonate and a generation layer of trigonal selenium. Conductive substrate 14 is made preferably from aluminized Mylar which is electrically grounded. Belt 10 moves in the direction of arrow 16 to advance successive portions of photoconductive surface 12 through the various processing station disposed about the path of movement thereof. Belt 10 is entrained about stripping roller 18, tension roller 20, and drive roller 22. Drive roller 22 is mounted rotatably and in engagement with belt 10. Roller 22 is coupled to motor 24 by suitable means such as belt drive. Motor 24 rotates roller 22 to advance belt 10 in the direction of arrow 16. Drive roller 22 includes a pair of opposed, spaced edge guides. The edge guides define a space therebetween which determines the desired path of movement of belt 10. Belt 10 is maintained in tension by a pair of springs (not shown) resiliently urging tension roller 20 against belt 10 with the desired spring force. Both stripping roller 18 and tension roller 20 are mounted to rotate freely.

With continued reference to FIG. 3, initially a portion of belt 10 passes through charging station A. At charging station A, a corona generating device, indicated generally by the reference numeral 26, charges photoconductive surface 12 to a relatively high, substantially uniform potential.

Thereafter, the charged portion of the photoconductive surface 12 is advanced through exposure station B. At exposure station B, an original document 28 is positioned face-down upon transparent platen 30. Lamps 32 flash light rays onto original document 28. The light rays reflected from original document 28 are transmitted through lens 34 forming a light image thereof. Lens 34 focuses the light image onto the charged portion of photoconductive surface 12 to selectively dissipate the charge thereon. This records an electrostatic latent image on photoconductive surface 12 which corresponds to the informational areas contained within original document 28.

Next, belt 10 advances the electrostatic latent image recorded on photoconductive surface 12 to development station C. At development station C, a magnetic brush development system, indicated generally by the reference numeral 36, transports a developer material into contact with photoconductive surface 12. Preferably, the developer material comprises carrier granules having toner particles adhering triboelectrically thereto. Magnetic brush system 36 preferably includes two magnetic brush developer rollers 38 and 40. These developer rollers each advance the developer material into contact with the photoconductive surface 12. Each developer roller forms a chain-like array of developer material extending outwardly therefrom. The toner particles are attracted from the carrier granules to the electrostatic latent image forming a toner powder image in photoconductive surface 12 of belt 10.

Belt 10 then advances the toner powder image to transfer station D. At transfer station D, a sheet of support material 42 is moved into contact with the toner powder image. The sheet of support material is advanced to transfer station D by a sheet feeding apparatus 44. Preferably, a sheet feeding apparatus 44 includes a feed roll 46 contacting the uppermost sheet of stack 48. Feed roll 46 rotates to advance the uppermost sheet from stack 48 into chute 50. Chute 50 directs the advancing sheet of support material into contact with photoconductive surface 12 in registration with the toner powder image developed thereon. In this way, the toner powder image contacts the advancing sheet of support material at transfer station D.

Transfer station D includes a corona generating device 52 which sprays ions onto the backside of sheet 42. This attracts the toner powder image from photoconductive surface 12 to sheet 42. After transfer, the sheet continues to move in the direction of arrow 54 onto a conveyor (not shown) which advances the sheet to fusing station E.

Fusing station E includes a fuser assembly, indicated generally by the reference numeral 56, which permanently affixes the transferred toner powder image to sheet 42. Preferably, a fuser assembly 56 includes a heated fuser roller 58 and a back-up roller 60. Sheet 42 passes between fuser roller 58 and a back-up roller 60 with the toner powder image contacting fuser roller 58. In this manner, the toner powder image is heated so as to be permanently affixed to sheet 42. After fusing, sheet 62 guides advancing sheet 42 to the decurling apparatus, indicated generally by the reference numeral 80. At this time, the sheet of support material has undergone numerous processes and very frequently contains undesired curls therein. This may be due to the various processes through which it has been subjected, or to the inherent mature of the sheet material itself. After passing through decurling apparatus 80 which simultaneously reduces sheet cross curl and process direction curl, the sheet of support material is advanced into catch tray 66 for subsequent removal from the printing machine by the operator. The detailed structure of decurling apparatus 80 will be described hereinafter with reference to FIGS. 1 and 2.

After the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 68 in contact with photoconductive surface 12. The pre-clean corona generating device neutralizes the charge attracting the particles to the photoconductive surface. The particles are then cleaned from photoconductive surface 12 by the rotation of brush 68 in contact therewith. Subsequent to cleaning, a discharge lamp (not shown) floods photoconductive surface 12 with light to dissipate any residual electrostatic charge remaining thereon prior to the charging thereof for the next successive image cycle.

Figure 1:
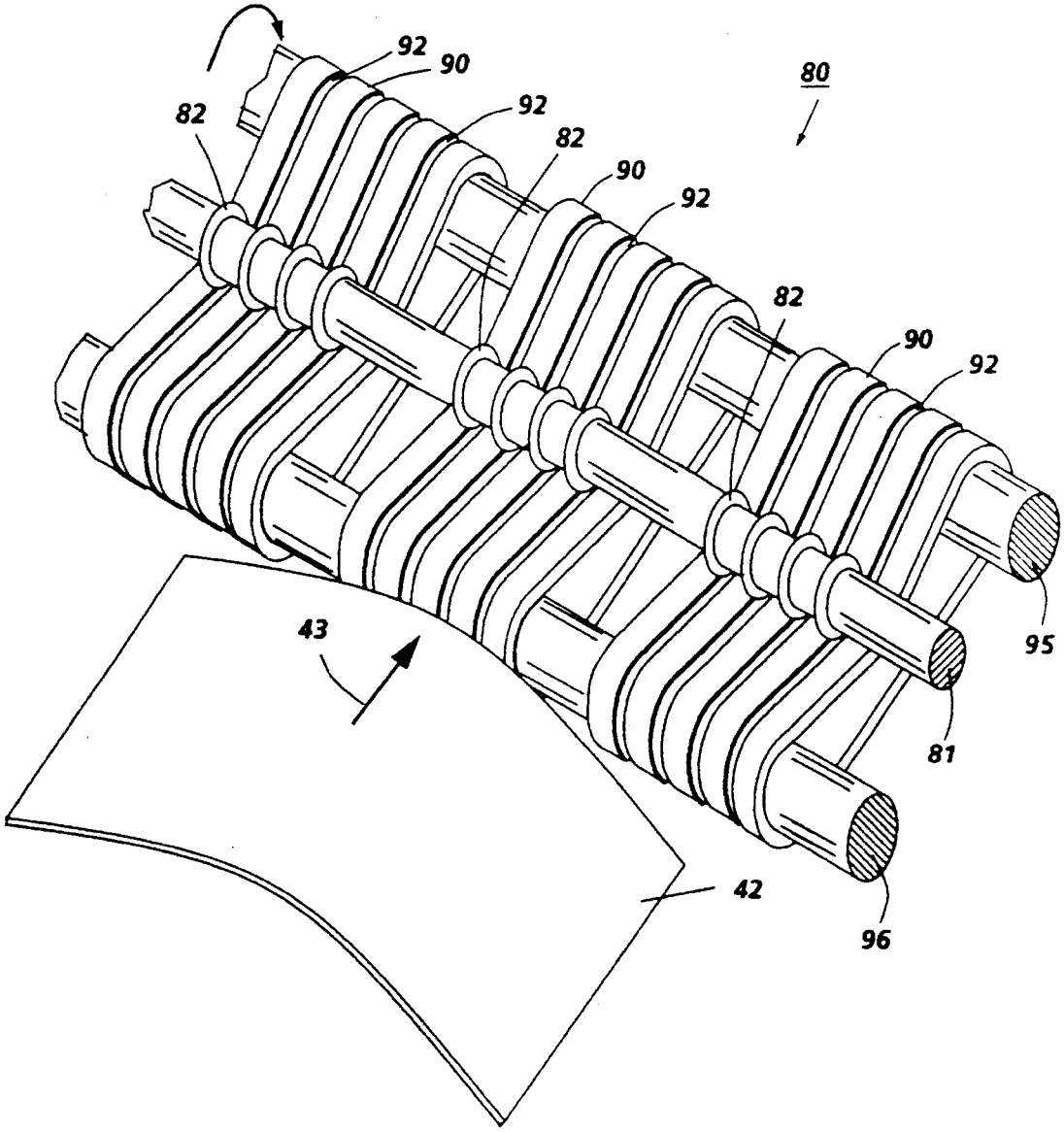
FIG. 1 is an isometric view showing the decurling apparatus of the present invention receiving a sheet of paper for cross curl reduction.

Referring now to the subject matter of the present invention, FIG. 1 depicts an embodiment 80 of the decurler apparatus of the present invention in detail. In consideration of the fact that the overall curl of an entire sheet of paper or the like is an accumulation of the curl of local areas, the reduction of the curl of the entire sheet can be achieved if all the local curls are reduced. Therefore, applying the principle of mechanical bending to reduce curl, the decurler 80 is adapted to apply local bendings in the cross direction. The decurling apparatus 80 of FIG. 1 features the use of a small, ribbed shaft 81 pinched against a plurality of segmented belts 90 having grooves 92 matched with the ribs 82. Segmented belts 90 are entrained around rotatably mounted shafts 95 and 96 and can be spaced away from each other by any desired amount. It is also contemplated that a single belt with uniformly or non-uniformly spaced grooves could be used with complimentary decurler shaft ribs in this decurler with desirable results. As a sheet of material 42, such as, paper is moved in the direction of arrow 43 and passes through the nip formed between ribs 82 and the belts 90, indentations of the ribs into grooves 92 of belts 90 apply bending stresses to local areas of the paper. All the local bendings are toward the pinch shaft, opposite to the directions of the cross curl of the incoming sheet 42. Although the bending is not uniform across the cross direction, the overall cross curl level of the paper can be significantly reduced.

Figure 2:
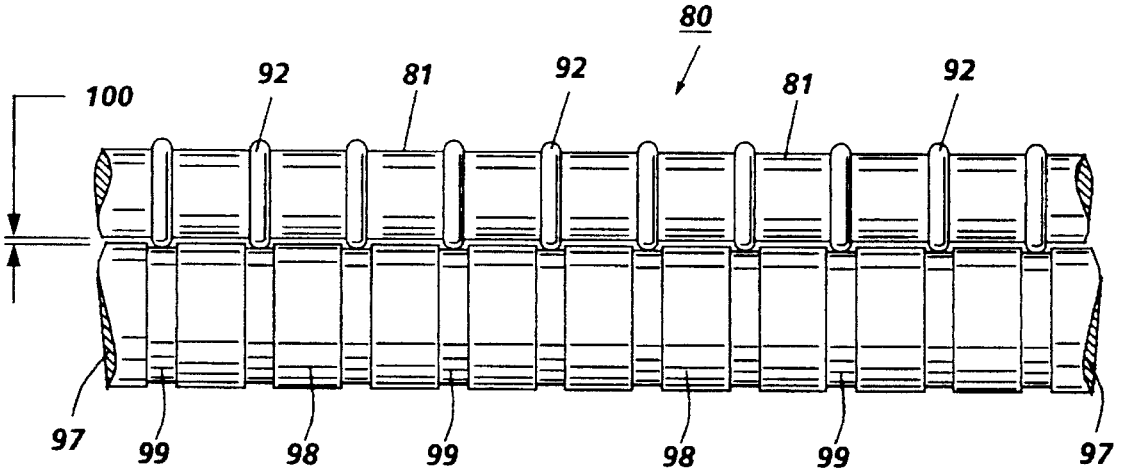
FIG. 2 is an end view of an alternative embodiment of the decurler apparatus of the present invention.

In an alternative embodiment of the cross curl decurler of the present invention in FIG. 2, a shaft 81 with ribs 92 thereon is in engagement with a segmented roll or shaft 97. The segmented shaft 97 has segments 98 that are spaced apart thereon to form grooves 99 into which ribs 92 penetrate to provide local bendings to reduce cross curl. The interference of the ribs, the contact radius of the ribs and the spacings are designed to avoid making marks on the copy sheet and not to impact image quality. A gap 100 is present between decurler shaft 81 and segments 98 of shaft 97 to allow for lateral movement of sheets due to local bending. All of the local bendings are toward the grooves 99 of shaft 97 and there is no bending in the reverse direction, therefore, all of the bending takes place in one direction. In short, all of the local bending provides one-sided corrugations.

It is, therefore, evident that there has been provided in accordance with the present invention a decurler apparatus and method for copiers/printers or the like which serves to distribute local bendings to reduce curl in copy sheets thereby fully satisfying the aims and advantages hereinbefore set forth. The distributed local bendings of sheets are accomplished by use of a shaft with ribs spaced along its surface that are engaged with grooves in elastomeric belt(s) or roll(s). All the local bendings are toward the ribbed shaft, opposite to the directions of the cross curl of the incoming sheets.

While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A decurling system for removing both process direction and cross direction curl from sheets being transported within a printing apparatus or a finisher, comprising: at least one endless belt having a series of grooves in an outer surface thereof, said endless belt being rotatably mounted on support members with an unsupported span between said support members; a decurler shaft, said decurler shaft having a series of ribs adapted for engagement with said grooves in said endless belt to form nips with said grooves of said endless belt to provide localized bendings to sheets passing therethrough in order to minimize cross curl in the sheets.

2. The decurling system of claim 1, wherein said grooves are uniformly spaced on said endless belt.

3. The decurling system of claim 2, wherein said grooves are non-uniformly spaced on said endless belt.

4. The decurling system of claim 2, wherein said second decurler includes a series of segmented rolls; and a decurler shaft, said decurler shaft having a series of ribs adapted for engagement with grooves between said segmented rolls to form nips with said grooves to provide localized bendings to sheets passing therethrough in order to minimize cross curl in the sheets.

5. The decurling system of claim 1, wherein the process direction and cross direction curl are removed simultaneously.

6. A printing machine adapted to produce copies on sheets fed through a plurality of processing stations in the machine including a fuser, the machine having a sheet decurler system for removing both in process direction and cross direction curl in the sheets after they have left the fuser, the sheet decurler system comprising:

at least one endless belt having grooves therein and supported with a free span portion and a decurler shaft, said decurler shaft having a series of ribs thereon adapted for engagement with said grooves in said endless belt to form one-sided corrugations with said grooves of said endless belt to provide localized bendings to sheets passing therethrough in order to minimize cross curl in the sheets.

7. The printing machine of claim 6, wherein said at least one belt includes a plurality of belts.

8. The printing system of claim 6, wherein the process direction and cross direction curl are removed simultaneously.

9. A printing machine adapted to produce copies on sheets fed through a plurality of processing stations in the machine including a fuser, the machine having a sheet decurler system for removing both in process direction and cross direction curl in the sheets after they have left the fuser, the sheet decurler system comprising: a series of segmented rolls; and a decurler shaft, said decurler shaft having a series of ribs adapted for engagement with grooves between said segmented rolls to form nips with said grooves to provide localized bendings to sheets passing therethrough in order to minimize cross curl in the sheets.

10. The printing system of claim 9, wherein the process direction and cross direction curl are removed simultaneously.

11. A method for removing curl from sheets fed in a predetermined direction after they have left a fuser apparatus, comprising the steps of:

providing a decurler apparatus;

feeding sheets through said decurler apparatus in a single predetermined feed direction;

removing feed direction curl from the sheets with said decurler apparatus while the sheets are fed in said predetermined feed direction and;

removing cross direction curl in a direction perpendicular to said feed direction while the sheets are fed in said predetermined feed direction with said decurler apparatus created in the sheets while removing curl in said feed direction without rotating the sheet.

12. The method of claim 10, including the step of simultaneously removing cross directional and non-cross directional curl.

* * * * *